US005855080A

United States Patent [19]

Van Staden

[11] Patent Number: 5,855,080

[45] Date of Patent: Jan. 5, 1999

[54] MUSICAL SHOE CONSTRUCTION

[76] Inventor: Will H. Van Staden, 8364 B Roswell Rd., Atlanta, Ga. 30350

[21] Appl. No.: 941,003

[22] Filed: Sep. 30, 1997

[51] Int. Cl.[6] ..... A43B 23/00

[52] U.S. Cl. ..... 36/139; 84/730

[58] Field of Search ..... 36/136, 139; 84/730, 84/743

[56] References Cited

U.S. PATENT DOCUMENTS

| | | | |
|---|---|---|---|
| 4,660,305 | 4/1987 | Medler et al. | 36/139 |
| 4,771,556 | 9/1988 | Kim | 36/139 |
| 5,001,852 | 3/1991 | Schwartz | 36/139 |
| 5,402,590 | 4/1995 | Lee | 36/139 |
| 5,421,107 | 6/1995 | Bryan | 36/139 |
| 5,483,759 | 1/1996 | Silverman | 36/137 |
| 5,615,111 | 3/1997 | Raskas et al. | 36/136 |
| 5,714,706 | 2/1998 | Nakada et al. | 36/139 |

FOREIGN PATENT DOCUMENTS 54-19338 7/1979 Japan .

*Primary Examiner*—M. D. Patterson
*Attorney, Agent, or Firm*—Henderson & Sturm

[57] ABSTRACT

A musical shoe construction 10 including a plurality of piezo electric sensor disks 40 imbedded in and disposed around the periphery of the heel and toe portions of a rubberized sole element 23 of the lower shoe portion 22. Each of the sensor disks 40 is associated with an individual oscillator circuit 41 to produce a distinctive musical tone in response to the application of an external force to one or more of the sensors 40.

5 Claims, 1 Drawing Sheet

MUSICAL SHOE CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of shoe constructions in general, and in particular to a shoe construction having sound generating capacity.

2. Description of Related Art

As can be seen by reference to the following U.S. Pat. Nos. 4,771,556; 5,402,590; 5,421,107; and 5,483,759, the prior art is replete with music generating shoe constructions which produce a repetitive musical pattern.

While all of the aforementioned prior art constructions are more than adequate for the basic purpose and function for which they have been specifically designed, they are uniformly deficient with respect to their failure to provide a simple, efficient, and practical musical shoe construction wherein the frequency and sequence of the musical tones that are produced by the shoes are governed and controlled by the person wearing the shoes.

As anyone who is familiar with the prior art shoe construction is all too well aware, the repetitive nature of the musical tones generated by the shoe or shoes becomes less attractive over time to the point wherein the repetition becomes a nuisance.

As a consequence of the foregoing situation, there has existed a longstanding need for a new and improved type of musical shoe construction that not only is capable of generating a variable musical tone pattern, but one that is dictated by the person wearing the shoe and the provision of such a construction is a stated objective of the present invention.

BRIEF SUMMARY OF THE INVENTION

Briefly stated, the musical shoe construction that forms the basis of the present invention comprises in general a shoe unit and a musical signal generating unit imbedded into a portion of the shoe unit. The musical signal generating unit is capable of generating individual musical tones in response to the application of an external force to selective portions of the lower portions of the shoe unit.

As will be explained in greater detail further on in the specification, a plurality of piezo-electric sensor disks are imbedded in and disposed around the periphery of the heel and toe portions of a rubberized sole element on the lower portion of the shoe member.

In addition, each of the piezo-electric sensor disks generate an electrical voltage signal in response to the application of an external force wherein each voltage signal is transmitted to a dedicated oscillator circuit to produce a distinctive musical tone that is generated through a low profile speaker which is disposed in an opening in the bottom of the rubberized sole element.

In this manner, the person wearing shoes constructed in accordance with the teachings of this invention can produce varying musical tones by the selective application of an external force to different portions of the sole element such as in the act of dancing or the like.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
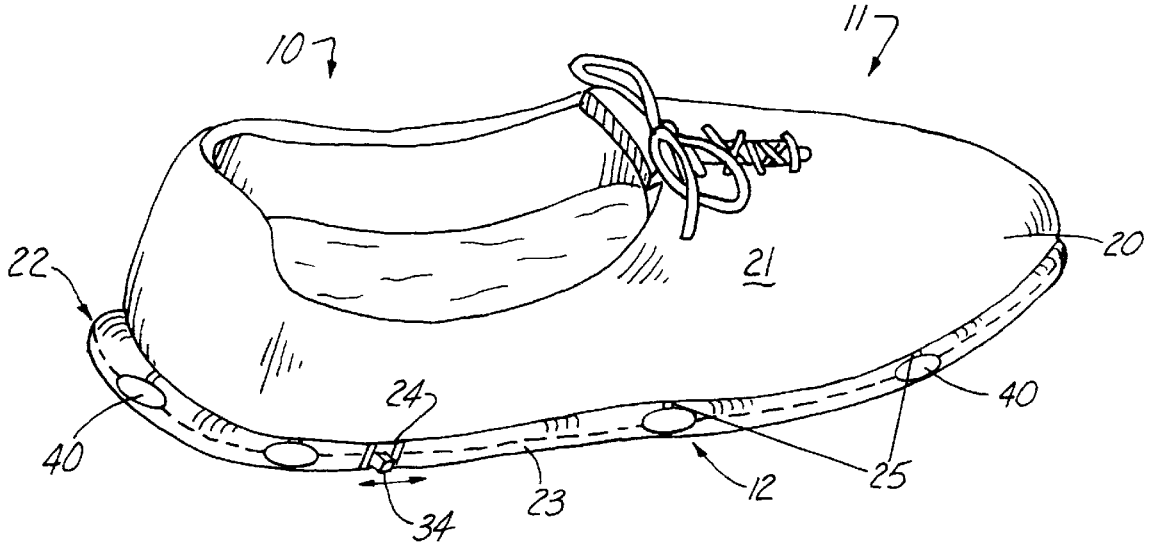
FIG. 1 is a perspective view of a musical shoe construction fabricated in accordance with the teaching of this invention.

As can be seen by reference to the drawings, and in particularly to FIG. 1, the musical shoe construction that forms the basis of the present invention is designated generally by the reference number 10. The shoe construction 10 comprises in general a shoe unit 11 and a musical tone generating unit 12. These units will now be described in seriatim fashion.

As can best be seen by reference to FIG. 1, the shoe unit 11 comprises in general a conventional footwear member 20 having an upper portion 21 and a lower sole portion 22. The sole portion 22 in the preferred embodiment of the invention includes a generally flexible resilient rubberized sole element 23 which will be described in greater detail presently.

Figure 2:
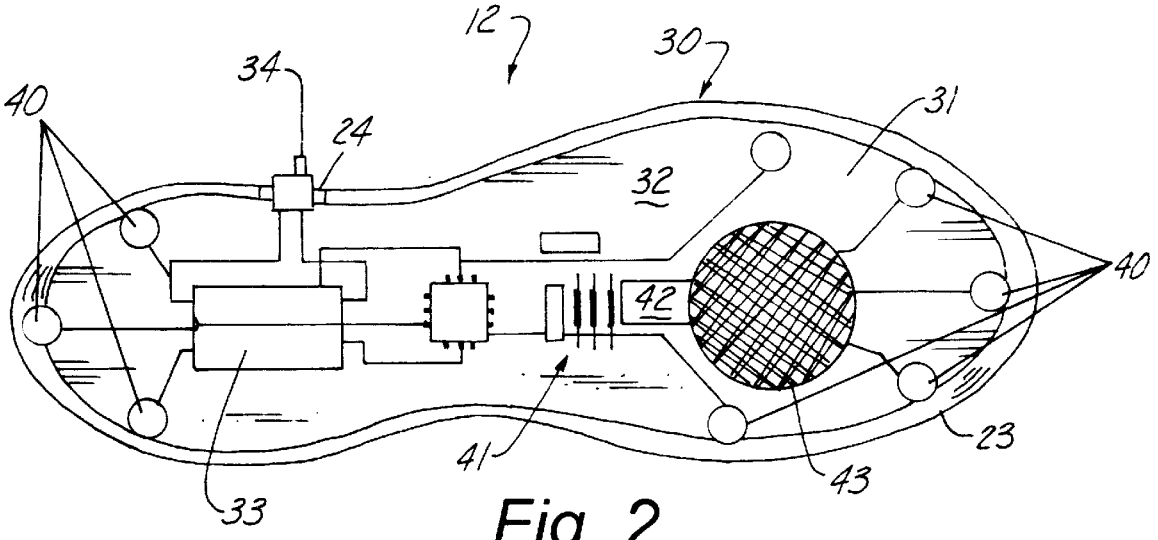
FIG. 2 is a schematic diagram of the musical tone generating unit.

Turning now to FIGS. 1 and 2, it can be seen that the musical tone generating unit 11 is embedded in the rubberized sole element 23 and comprises a tone generating member 30 including a flexible electronic circuit board member 31 fabricated from a flexible Kapton circuit board material 32.

The circuit board 31 is powered by a pair of batteries 33 which are controlled by an on/off switch 34 which project through a suitably dimensioned aperture 24 formed in the side of the rubberized sole element 23. In addition, the circuit board member 31 is electrically coupled to a plurality of piezo-electric sensor disks 40 which are arrayed around the periphery of the sole element 23 in the vicinity of both the heel and toe portions of the sole element 23.

Figure 3:
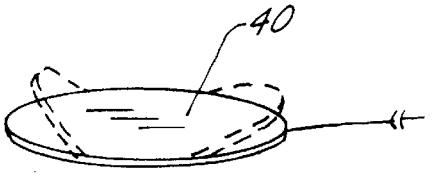
FIG. 3 is an enlarged isolated view of a piezo-electric disk sensor.

Each of the sensor disks 40 generate an electrical voltage whenever they are physically or mechanically stressed as indicated by the dashed lines in FIG. 3, such as by the impact forces generated by dancing. The downward force is purposefully concentrated by the user on a specific area within the toe and/or heel portions of the sole element 23.

The voltage signals from each of the sensor disks 40 are transmitted to a specific oscillator circuit designated generally as 41 and tuned according to the musical scales wherein each sensor disk generates a different musical tone. Furthermore, the output of the audio oscillators 41 are connected to the input of an audio amplifier 42 which is connected to a low profile speaker element 43 which is disposed in a suitably dimensioned opening (not shown) formed in the bottom of the sole element 23.

Turning once more to FIG. 1, it can be seen that the external periphery of the sole element 23 are provided with raised indicia portions 25 which are representative of the general location of each of the imbedded sensor disks 40 relative to the bottom of the sole element 23.

In addition, it should be emphasized at this juncture that this invention contemplates the use of eight sensor disks 40 in each shoe of a pair of shoes. One shoe features musical tones from low C to middle C and the other shoe features musical tones from middle C to high C. In this manner, the user can produce a variety of selected musical tones in different frequencies and sequence sin the act of dancing.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A musical shoe construction comprising:

a shoe member including a shoe upper portion and a shoe lower portion wherein the shoe lower portion comprises a rubberized sole element; and a musical tone generating unit imbedded in said sole element and comprising a circuit board member connected to a plurality of electrical signal generating means disposed at various locations on the toe and heel portions of the sole element; wherein each of the electrical signal generating means generates a different tone in response to an external stimulus;

wherein each of the electrical signal generating means includes a piezo-electric sensor disk which generates an electrical voltage in response to an externally applied force; and wherein each piezo-electric sensor disk is connected to a specific oscillator circuit which is different from the oscillator circuits associated with the remaining plurality of piezo-electric sensor disks.

2. The musical shoe construction as in claim 1 wherein each of the outputs of the oscillator circuits pass through an audio amplifier.

3. The musical shoe construction as in claim 2 wherein the audio amplifier is connected to a low profile speaker element.

4. A musical shoe construction for generating a plurality of different musical tones in response to the application of external forces on selected portions of the shoe construction which comprises:

a shoe member including a shoe upper portion and a shoe lower portion comprising a rubberized sole element having a toe portion and a heel portion; and a musical tone generating unit including a plurality of electrical signal generating means disposed at a variety of different locations on the heel and toe portions of the rubberized sole element wherein each of the plurality of electrical signal generating means are selectively actuated in response to an externally applied force; wherein each of the plurality of electrical signal generating means is connected to a specific oscillator circuit to produce a distinctive tone.

5. The musical shoe construction as in claim 4 wherein each of the plurality of electrical signal generating means comprise a piezo-electric sensor disk.

* * * * *